United States Patent [19]

Sluijter et al.

[11] Patent Number: 4,637,046

[45] Date of Patent: Jan. 13, 1987

[54] SPEECH ANALYSIS SYSTEM

[75] Inventors: Robert J. Sluijter; Hendrik J. Kotmans, both of Eindhoven, Netherlands

[73] Assignee: U.S. Philips Corporation, New York, N.Y.

[21] Appl. No.: 487,389

[22] Filed: Apr. 21, 1983

[30] Foreign Application Priority Data

Apr. 27, 1982 [EP] European Pat. Off. ..... 82200501.3

[51] Int. Cl.[4] ..... G10L 5/00

[52] U.S. Cl. ..... 381/49

[58] Field of Search ..... 364/513.5; 381/36–50

[56] References Cited

U.S. PATENT DOCUMENTS

| | | | |
|---|---|---|---|
| 4,015,088 | 3/1977 | Dubnowski et al. | 381/49 |
| 4,331,837 | 5/1982 | Sommague | 381/46 |
| 4,351,983 | 9/1982 | Crouse et al. | 381/46 |
| 4,359,604 | 11/1982 | Dumont | 381/46 |
| 4,441,200 | 4/1984 | Fette et al. | 381/36 |

OTHER PUBLICATIONS

Rabinev et al., IEEE Transactions on Acoustics, Speech and Signal Processing, vol. ASSP-24, No. 5, Oct. 1976, pp. 399–418.

*Primary Examiner*—E. S. Matt Kemeny
*Assistant Examiner*—M. Yuen
*Attorney, Agent, or Firm*—Robert T. Mayer; Bernard Franzblau

[57] ABSTRACT

A speech analysis system in which segments of digitized speech are transformed into amplitude spectrums. For the voiced/unvoiced decision use is made of the peak value or spectral intensity in each amplitude spectrum. Basically a voiced decision is made when the spectral intensity increases monotonically over several segments by more than a given factor. An unvoiced decision is made if the spectral intensity drops below a given fraction of the maximum spectral intensity in the current voiced period. Refinements in the decisions are made by the use of fixed and adaptive thresholds.

2 Claims, 3 Drawing Figures

SPEECH ANALYSIS SYSTEM

BACKGROUND OF THE INVENTION (1) Field of the invention.

This invention relates to a speech analysis system comprising means for converting an input analog speech signal into a digital speech signal, means for storing segments of said digital speech signal, means for transforming each segment into a sequence of spectrum components, which means comprise means for performing a discrete Fourier transformation, whereby a series of amplitude spectrums each consisting of a sequence of spectrum components is produced.

(2) Description of the prior art.

Such a speech analysis system is generally known in the art of vocoders. As an example reference may be made to IEEE Transactions on Acoustics, Speech and Signal Processing, Vol. ASSP, No. 7, Aug. 1978, pp 358–365. In the prior art system disclosed therein the amplitude spectrums are supplied to a harmonic pitch detector for detecting the pitch period from the frequency distances between the peaks of the envelope of each amplitude spectrum.

It has been mentioned, that basically, a pitch detector is a device which makes a voiced-unvoiced (V/U) decision, and, during periods of voiced speech, provides a measurement of the pitch period. However, some pitch detection algorithms just determine the pitch during voiced segments of speech and rely on some other technique for the voiced-unvoiced decision. Cf. IEEE Transactions on Acoustics, Speech and Signal Processing, Vol. ASSP-24, No. 5, Oct. 1976, pp 399–418.

Several voiced-unvoiced detection algorithm are described in said last publication, based on the autocorrelation function, a zero-crossing count, a pattern recognition technique using a training set, or based on the degree of agreement among several pitch detectors. These detection algorithms use as input the time domain or frequency domain data of the speech signal in practically the whole speech band, while for pitch detection on the contrary the data of a low pass filtered speech signal are generally used.

SUMMARY OF THE INVENTION

It is an object of the invention to provide in the aforementioned speech analysis system a method of voiced-unvoiced detection that uses as an input the same spectral data that are generally used as an input for pitch detection i.e. the data of a low pass filtered speech signal, in particular in the frequency range between about 200–800 Hz.

In the speech analysis system in accordance with the invention provision is made of a bistable indicator settable to indicate a period of voiced speech and resettable to indicate a period of unvoiced speech or the absence of speech, and programmable computing means programmed to carry out the proces including the steps of :

determining for each segment (number I) the peak value (M(I) ) of the spectrum components of the relevant amplitude spectrum in a low frequency band of about 200–800 Hz, determining, if said indicator is set, for each segment and a number of preceding segments the maximum value (VM (I) ) of the peak values M(n), with $n=I, I-1, \ldots I+1-m$, in which m is such that between segments I en $I+1-m$ there is no change in the state of the indicator, determining for each segment an adaptive threshold (AT(I) ) by setting AT(I) equal to a fraction of the maximum value VM(I) if said indicator is set and by setting AT(I) equal to a fraction of $AT(I-1)$ if said indicator is reset, setting the bistable indicator if the peak values M(n) with $n=I, I-1, \ldots I+1-k$, wherein k is a predetermined number, increase monotonically for increasing values of n, by more than a given factor and M(I) exceeds the adaptive threshold $AT(I-1)$, resetting the bistable indicator if the peak value M(I) is smaller than a given fraction of the maximum value $VM(I-1)$ or is smaller than a predetermined threshold.

In accordance with this method the unvoiced-to-voiced decision is made if subsequent peak values, also termed spectral intensities, including the most recent one, increase monotonically by more than a given factor, which is practice may be the factor three, and if in addition, the most recent spectral intensity exceeds a certain adaptive threshold. In speech, the onset of a voiced sound is nearly always attended with the mentioned intensity increase. However unvoiced plosives sometimes show strong intensity increases as well, in spite of the bandwidth limitation.

Indeed some unvoiced plosives are effectively excluded because almost all their energy is located above 800 Hz, but others show significant intensity increases in the 200–800 Hz band. The adaptive threshold makes a distinction between intensity increases due to unvoiced plosives and voiced onsets. It is initially made proportional to the maximum spectral intensity of the previous voiced sound, thus following the coarse speech level. In unvoiced sounds, the adaptive threshold decays with a large time constant. This time constant should be such, that the adaptive threshold is nearly constant between two voiced sounds in fluent speech to prevent intermediate unvoiced plosives being detected as voiced sounds. But after a distinct speech pause the adaptive threshold must have decayed sufficiently to enable the detection of subsequent low level voiced sounds. Too large a threshold would incorrectly reject voiced onsets in this case. A time constant of typically a few seconds appears to be a suitable value.

The voiced-to-unvoiced transition is ruled by a threshold, the magnitude of which amounts to a certain fraction of the maximum intensity in the current voiced speech sound. As soon as the spectral intensity becomes smaller than this threshold, it is decided for a voiced-to-unvoiced transition.

A large fixed threshold is used as a safeguard. If the spectral intensity exceeds this threshold the segment is directly classified as voiced. The value of this threshold is related to the maximum possible spectral intensity and may in practice amount to 10% thereof.

Additionally, a low-level predetermined threshold is used. Segments of which the spectral intensities do not exceed this threshold are directly classified as unvoiced. The value of this threshold is related to the maximum possible spectral intensity and may in practice amount to 0.4% thereof.

The time lag between successive segments in different types of vocoders is usually between 10 ms and 30 ms. The minimum time interval to be observed in the voiced-unvoiced detector for a reliable decision should amount to 40–50 ms. Since the minimum time lag is assumed to be 10 ms observation of six (k=6) subsequent segments is sufficient to cover all practical cases.

Figure 1:
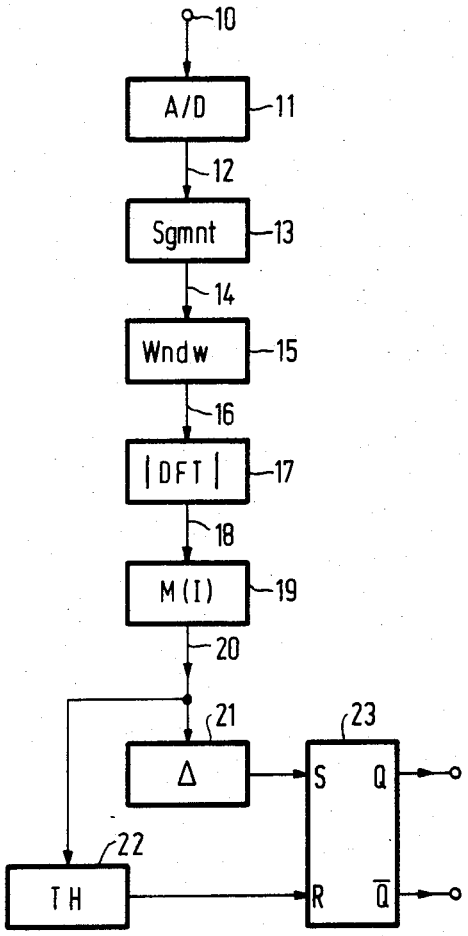
FIG. 1 is a flow diagram illustrating the succession of operations in the speech analysis system according to the invention.

In the system shown in FIG. 1 a speech signal in analog form is applied at 10 as an input to an analog-to-digital conversion operation, represented by block 11, having a sampling rate of 8 kHz and an accuracy of 12 bits per sample. The digital samples appearing at 12 are applied to a segment buffering operation, represented by block 13, providing storage for a segment of digitized speech of 32 ms corresponding to 256 samples.

In the embodiment complete segments of digitized speech appear at 14 with intervals of 10 ms. During each period of 10 ms 80 new samples are stored by the operation of block 13 and the 80 oldest samples are discarded. The intervals may have another value than 10 ms and may be adapted to the value, generally between 10 ms and 30 ms, as used in the relevant vocoder.

The 256 samples of a segment are next multiplied by a Hamming window by the operation represented by block 15. The window multiplied samples appearing at 16 subsequently undergo a discrete Fourier transformation, represented by block 17 and the absolute value of each discrete spectrum component is determined therein from the real and imaginary parts thereof.

At 18 there appears every 10 ms a sequence of 128 spectrum components (in absolute value) which are supplied to block 19, wherein the peak value of the spectrum components in the frequency range of about 200–800 Hz is determined. The peak value for the segment having the number I is indicated by M(I) and is also termed the spectral intensity of the speech segment in the relevant frequency range.

The spectral intensities M(I) appearing at 20 with 10 ms intervals are subsequently processed in the blocks 21 and 22.

In the block 21 it is determined whether the spectral intensities of a series of segments including the last one is monotonically increasing by more than a given factor. In the embodiment six segments are considered and the factor is three. Also it is determined whether the spectral intensity exceeds an adaptive threshold. This adaptive threshold is a given fraction of the maximum spectral intensity in the preceding voiced period or is a value decreasing with time in an unvoiced period. A large fixed threshold is used as a safeguard. If the spectral intensity exceeds this value the segment is directly classified as voiced.

If the conditions of block 21 are fulfilled a bistable indicator 23 is set to indicate at the true output $\overline{Q}$ a period of voiced speech.

In block 22 it is determined whether the spectral intensity falls below a threshold which is a given fraction of the maximum spectral intensity in the current voiced period or falls below a small fixed threshold. If these conditions are fulfilled the bistable indicator 23 is reset to indicate at the not-true output $\overline{Q}$ a period of unvoiced speech.

Figure 2:
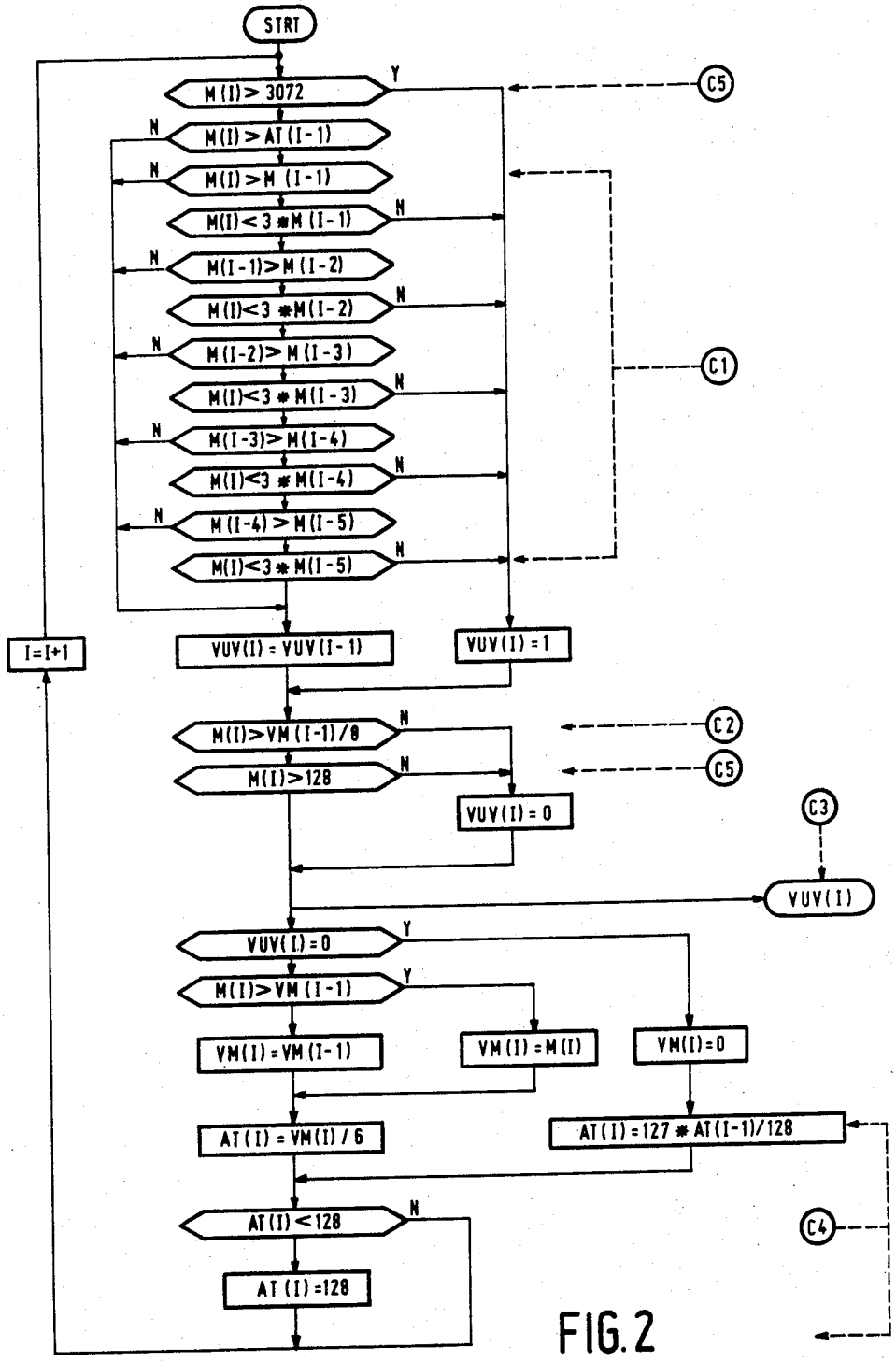
FIG. 2 is a flow diagram of a computer program which is used for carrying out certain operations in the process according to FIG. 1.

Certain operations in the process according to FIG. 1 may be fulfilled by suitable programming of a general purpose digital computer. Such may be the case for the operations performed by the blocks 21 and 22 in FIG. 1. A flow diagram of a computer program for performing the operations of the blocks 21 and 22 is shown in FIG. 2. The input to this program is formed by the numbers M(I) representing the spectral intensities of the successive speech segments.

In this diagram I stands for the segment number, AT for the adaptive threshold, VM for the maximum intensity of consecutive voiced segments, VUV is the output parameter, VUV=1 for voiced speech and VUV=0 for unvoiced speech. This parameter corresponds to the state of the bistable indicator 23 previously discussed with respect to FIG. 1.

The flow diagram is readily understandable by a man skilled in the art without further description. The following comments (C1–C5 in the figure) are presented:

Comment C1: determining whether the spectral intensity M increases monotonically over the segments I, I−1, . . . I−5 by more than a factor three, Comment C2: resetting the bistable indicator (VUV=0) if M(I) is smaller than a given fraction ($\frac{1}{8}$) of the previously established maximum intensity VM(I−1), Comment C3: output of VUV(I), corresponding to the state of the aforesaid bistable indicator 23, Comment C4: determining the adaptive threshold AT, Comment C5: the large fixed threshold is fixed at the value of 3072; the small fixed threshold is fixed at the value of 128.

Figure 3:
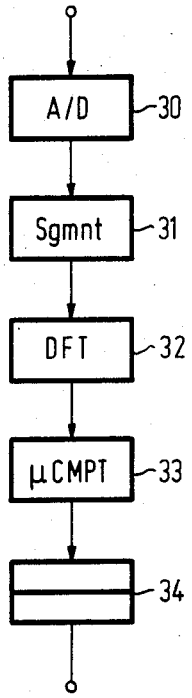
FIG. 3 is a schematic block diagram of electronic apparatus for implementing the speech analysis system according to the invention.

The speech analysis system according to the invention may be implemented in hardware by the hardware configuration which is illustrated in FIG. 3. This configuration comprises:

an A/D converter 30 (correspodning to block 11 in FIG. 1)

a segment buffer 31 (block 13, FIG. 1)

a DFT processor 32 which simultaneously performs the window multiplication function (blocks 15 and 17 of FIG. 1)

a micro-computer 33 (blocks 19, 21 and 22, FIG. 1)

a bistable indicator 34 (block 23, FIG. 1).

The function of block 19 i.e. determining the peak value of a series of values can be performed by suitable programming of computer 33. A flow diagram of a suitable program can be readily devised by a man skilled in the art.

What is claimed is:

1. In a speech analysis system comprising means for converting an input analog speech signal into a digital speech signal, means for storing segments of said digital speech signal, means for transforming each segment into a sequence of spectrum components, which means comprise means for performing a discrete Fourier transformation, whereby a series of amplitude spectrum each consisting of a sequence of spectrum components is produced, a bistable indicator settable to indicate a period of voiced speech and resettable to indicate a period of unvoiced speech or the absence of speech, and programmable computing means programmed to carry out the process including the steps of:

determining for each segment (number I) the peak value (M(I)) of the spectrum components of the relevant amplitude spectrum in a low frequency band of about 200–800 Hz, determining, if said indicator is set, for each segment and a number of preceding segments the maximum value (VM(I)) of the peak values M(n), with n=I, I−1, . . . I+1−m, in which m is such that between segments I and I+1−m there is no change in the state of the indicator, determining for each segment an adaptive threshold (AT(I)) by setting AT(I) equal to a fraction of the maximum value VM(I) if said indicator is set and by setting AT(I) equal to a fraction of AT(I−1) if said indicator is reset, setting the bistable indicator if the peak values M(n) with n=I, I−1, . . . I+1−k, wherein k is a predetermined number, increase monotonically for increasing values of n, by more than a given factor and M(I) exceeds the adaptive threshold AT(I−1), and resetting the bistable indicator if the peak value M(I) is smaller than a given fraction of the maximum value VM(I−1) or is smaller than a predetermined threshold.

2. The process according to claim 1 characterized in that it comprises the steps of:

setting the bistable indicator if the peak value M(I) exceeds a relatively high fixed threshold, and resetting the bistable indicator if the peak value M(I) does not exceed a relatively low fixed threshold.

* * * * *